US006737938B2

(12) United States Patent
Kitamori et al.

(10) Patent No.: US 6,737,938 B2
(45) Date of Patent: May 18, 2004

(54) PHASE SHIFTER, PHASED-ARRAY ANTENNA, AND RADAR

(75) Inventors: Nobumasa Kitamori, Kyoto-fu (JP); Toshiro Hiratsuka, Kyoto-fu (JP)

(73) Assignee: Murata Manufacturing Co., Ltd., Nagaokakyo (JP)

( * ) Notice: Subject to any disclaimer, the term of this patent is extended or adjusted under 35 U.S.C. 154(b) by 0 days.

(21) Appl. No.: 10/116,795

(22) Filed: Apr. 5, 2002

(65) Prior Publication Data

US 2002/0153968 A1 Oct. 24, 2002

(30) Foreign Application Priority Data

Apr. 16, 2001 (JP) ..... 2001-116988

(51) Int. Cl.[7] ..... H01P 1/18

(52) U.S. Cl. ..... 333/161; 333/162; 343/758; 343/882

(58) Field of Search ..... 333/156–159, 333/161, 162; 343/754, 758, 882, 700 MS

(56) References Cited

U.S. PATENT DOCUMENTS

| | | | | |
|---|---|---|---|---|
| 2,716,221 A | | 8/1955 | Allen | |
| 2,836,814 A | | 5/1958 | Nail | |
| 2,836,821 A | | 5/1958 | Elliott | |
| 3,139,597 A | | 6/1964 | French et al. | |
| 3,568,208 A | * | 3/1971 | Hatcher et al. | 343/768 |
| 5,815,124 A | * | 9/1998 | Manasson et al. | 343/785 |
| 6,297,714 B1 | * | 10/2001 | Hirtzlin et al. | 333/135 |

FOREIGN PATENT DOCUMENTS

| | | |
|---|---|---|
| EP | 1 054 466 A2 | 11/2000 |
| WO | WO 00/54368 | 9/2000 |

OTHER PUBLICATIONS

W.T. Joines, "A Continuously Variable Dielectric Phase Shifter", IEEE Transactions on Microwave Theory and Techniques, IEEE Inc., New York, U.S.A., vol. 19, No. 8, pp. 729–732 (1971).

* cited by examiner

*Primary Examiner*—Kenneth B. Wells
(74) *Attorney, Agent, or Firm*—Ostrolenk Faber Gerb & Soffen

(57) ABSTRACT

A phase shifter includes upper and lower conductive plates, and a dielectric strip sandwiched between the conductive plates, and a plurality of slots formed in the upper conductive plate, thereby forming a dielectric line. A rotator is positioned at either side of the dielectric strip so that the distance from the rotator to the dielectric strip varies as the rotator rotates. As the rotator rotates, the phase constant of the dielectric line progressively changes in the direction of electromagnetic propagation. The rotation of the rotator causes a change in feed phase with respect to the slots as the rotator rotates, thereby performing beam scanning.

5 Claims, 5 Drawing Sheets

PHASE SHIFTER, PHASED-ARRAY ANTENNA, AND RADAR

BACKGROUND OF THE INVENTION

1. Field of the Invention

The present invention relates to a phase shifter for shifting the phase of signals propagating on a transmission line, and to a phased-array antenna and radar incorporating the phase shifter.

2. Description of the Related Art

A typical phase shifter for shifting the phase of electromagnetic waves propagating on a transmission line includes a dielectric plate which is positioned with respect to a waveguide so as to be freely insertable into the waveguide.

In an exemplary phased-array antenna including arrays of a plurality of slot antennas, a movable spacer plate can be moved back and forth to control feed phase with respect to each of the slot antennas to perform beam scanning.

However, such typical phase shifters or phased-array antennas have the following problems.

Since a typical phase shifter controls the phase by adjusting the amount by which the dielectric plate is inserted into the waveguide, for example, it is necessary to move the dielectric plate back and forth in order to periodically change the phase. The structure which facilitates the back-and-forth movement of the dielectric plate makes it difficult to maintain high mechanical reliability, and also makes it difficult to move the dielectric plate back and forth at high speed.

Furthermore, there has been no example in which a typical phase shifter is applied to a transmission line, such as a microstrip line, formed on a dielectric plate or a dielectric line formed by placing a dielectric strip between two metal plates.

A typical phased-array antenna requires a removable spacer plate to be moved back and forth in order to control feed phase with respect to a plurality of slot antennas, and it is difficult to control the phase at high speed.

SUMMARY OF THE INVENTION

Accordingly, it is an object of the present invention to provide a phase shifter capable of periodically controlling phase at high speed and formed of a planar transmission line such as a microstrip line or a dielectric line. Another object of the present invention is to provide a phased-array antenna which uses the phase shifter to achieve rapid beam scanning with a simplified overall structure, and to provide a radar which uses the phased-array antenna to quickly change the radar coverage range.

To this end, the present invention provides a phase shifter including a substantially planar dielectric plate, a conductive strip formed on the dielectric plate, and a rotator at least partially including a conductor and a dielectric, the rotator being positioned in proximity to the conductive strip so as to freely rotate.

Therefore, the conductive strip on the dielectric plate can serve as a planar transmission line such as a microstrip line. As the rotator rotates, the distance from the conductor or dielectric of the rotator to the conductive strip or the opposing areas changes, thereby changing the phase constant of the planar transmission line, thus causing a change in the phase of a signal propagating on the transmission line. The signal propagating on the transmission line changes in phase as the rotator rotates, thereby reducing the product of mass and acceleration (inertia resistance). This does not require large power in order to change in phase at high speed, thereby reducing the produced vibrations. Therefore, a simple motor can be used to perform the phase control at high speed and to maintain sufficiently high mechanical reliability.

Preferably, the rotation axis of the rotator is positioned substantially parallel to the conductive strip, thereby increasing the effect of the phase change as the rotator comes closer to the conductive strip.

A phase shifter according to the present invention may include two substantially planar conductive plates, a dielectric strip sandwiched between the two conductive plates, and a rotator at least partially including a conductor or a dielectric, the rotator being positioned at at least one side of the dielectric strip so as to freely rotate while the rotation axis of the rotator is substantially parallel to the conductive strip.

Therefore, the two conductive plates, and the dielectric strip sandwiched therebetween can form a dielectric line. As the distance from the conductor or dielectric positioned at either side of the dielectric strip to the dielectric strip, or the opposing areas changes, the phase constant of the dielectric line changes, thereby changing the phase of a transmission signal. The signal propagating on the transmission line changes in phase as the rotator rotates, and a large amount of power is not required to change phase at high speed, as previously described. Therefore, a simple motor can be used to perform the phase control at high speed and to maintain sufficiently high mechanical reliability. Since the rotator is positioned at either side of the dielectric strip, the overall thickness of the dielectric strip sandwiched between the two conductive plates can be reduced. The rotator may also be positioned at the two sides of the dielectric strip, thereby maintaining a large amount of phase shift.

Preferably, the rotation axis of the rotator is positioned substantially in parallel to the dielectric strip, thereby increasing the effect of the phase change as the rotator comes closer to the dielectric strip.

The rotator of the phase shifter may have a predetermined conductive pattern formed on a surface of a tubular or cylindrical dielectric base, and can thus be simplified. The conductive pattern formed on the surface allows a variety of phase-shift patterns as the rotator rotates. Alternatively, the rotator may be formed of a conductive member having a predetermined shape. The rotator can thus be easily produced. Variations of characteristics can also be reduced.

In another aspect of the present invention, a phased-array antenna includes a ground electrode formed on the above-described dielectric plate on which a conductive strip is formed, and a plurality of slots formed in the ground electrode, through which electromagnetic waves are emitted.

Therefore, a transmission line formed of the conductive strip can serve as a feed line for the slot antennas. The phase constant of the transmission line changes as the rotator rotates, thereby causing a change in feed phase with respect to the slot antennas, resulting in beam scanning. The phased-array antenna can therefore be constructed with a simplified overall structure. In addition, even if beam scanning is performed at high speed, the inertia resistance or vibrations can be reduced. Therefore, a simple motor can be used to perform the phase control at high speed with ease and to maintain sufficiently high mechanical reliability.

In another aspect of the present invention, a phased-array antenna includes microstrip antenna patches formed on the above-described dielectric plate on which a conductive strip is formed. Therefore, a line formed of the conductive strip can serve as a feed line for the aligned microstrip antenna patches. The phase constant of the line changes as the rotator rotates, thus causing a change in feed phase with respect to the microstrip antenna patches. The phased-array antenna can therefore be constructed with a simplified overall structure. In addition, even if beam scanning is performed at high speed, the inertia resistance or vibrations can be reduced. Therefore, a simple motor can be used to perform the phase control at high speed with ease and to maintain sufficiently high mechanical reliability.

In another aspect of the present invention, a phased-array antenna includes a plurality of slots formed in the conductive plate. Therefore, the slots can serve as slot antennas, and the dielectric line can serve as a feed line for the slot antennas. The rotation of the rotator causes a change in feed phase with respect to the slot antennas, resulting in beam scanning. The phased-array antenna can therefore be simple, compact, and lightweight.

In another aspect of the present invention, a radar includes any of the above-described phased-array antennas, and a transceiver using the phased-array antenna for transmission and reception. The radar can thus perform high-speed scanning and can be highly shock-resistant. In addition, a simple motor can be used to perform the phase control at high speed and to maintain sufficiently high mechanical reliability.

Other features and advantages of the present invention will become apparent from the following description of the invention which refers to the accompanying drawings.

BRIEF DESCRIPTION OF THE DRAWING(S)

DETAILED DESCRIPTION OF EMBODIMENTS OF THE INVENTION

A phase shifter according to a first embodiment of the present invention is now described with reference to FIGS. 1 to 4. In the first embodiment, a microstrip line is used as a transmission line.

Figure 1:
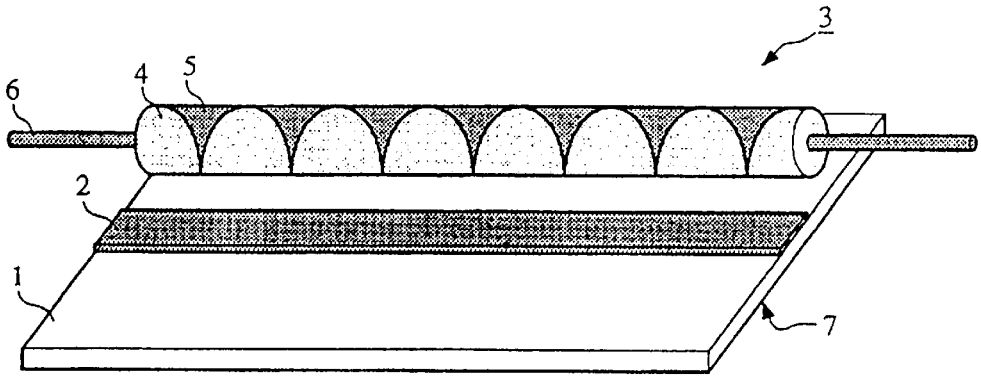
FIG. 1 is a perspective view of a phase shifter according to a first embodiment of the present invention.

FIG. 1 is a perspective view of the phase shifter. A conductive strip (strip line) 2 is formed on the top surface of a dielectric plate 1. A ground electrode 7 is formed on substantially all of the under surface of the dielectric plate 1. The dielectric plate 1, the ground electrode 7, and the conductive strip 2 form a microstrip line. The phase shifter further includes a rotator 3 having an electrode 5 of a predetermined pattern formed on a surface of a cylindrical dielectric base 4. A rotation shaft 6 of the rotator 3 extends substantially in parallel to the conductive strip 2 so as to sandwich the conductive strip 2 between the rotator 3 and the dielectric plate 1. As the rotator 3 rotates, the opposing areas of the conductive strip 2 and the electrode 5, and the opposing areas of the conductive strip 2 and the remaining dielectric portion of the dielectric base 4 vary, thereby changing the phase constant of the microstrip line. This results in a periodic change in the phase of a signal propagating on the microstrip line.

The center of gravity of the rotator 3 will not move in response to the rotation as long as the rotation axis matches the rotational symmetry axis, thus causing no vibration of the overall apparatus when it rotates at high velocity. This allows high-speed rotation, and remarkably increases the mechanical reliability.

Figure 2:
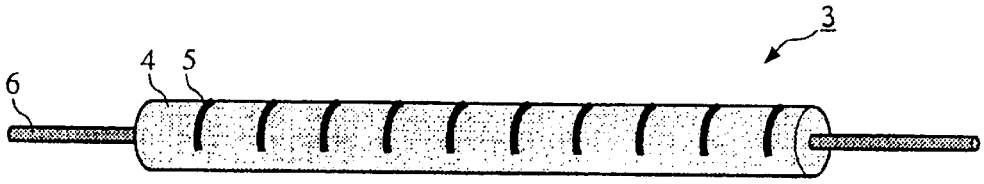
FIG. 2 shows a different rotator for use in the phase shifter.

FIG. 2 shows another example of the rotator 3. In the example shown in FIG. 1, a pattern is formed on the surface of the base 4 such that the opposing areas of the dielectric portion and the electrode 5 with respect to the conductive strip 2 successively vary according to rotation of the rotator 3. In the example shown in FIG. 2, however, electrodes 5 are formed on the periphery of the cylindrical base 4 so as to extend with substantially constant widths. The structure of the other components shown in FIG. 2 is the same as that in FIG. 1.

Such an electrode pattern allows for switching between a state where the electrode 5 faces the conductive strip 2 on the dielectric plate 1 and a state where the dielectric portion of the base 4 faces the conductive strip 2 according to the rotation of the rotator 3. This causes a change in the propagation constant of the microstrip line, thereby providing a switch for switching between propagation and non-propagation at a transmission frequency. Accordingly, the rotator 3 shown in FIG. 2 can function as a discontinuous phase-change switch.

Figure 3:
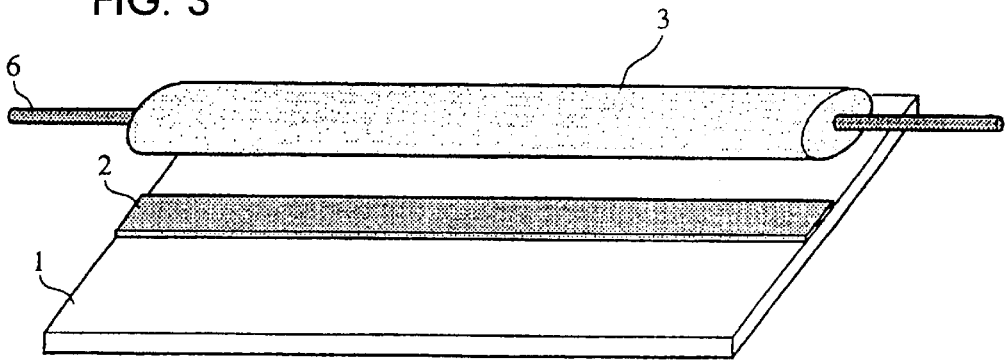
FIG. 3 is a perspective view of another phase shifter incorporating a different rotator.

FIG. 3 is a perspective view of a phase shifter including still another rotator 3 which is different from those shown in FIGS. 1 and 2. The rotator 3 is formed of an elliptical cylindrical conductive member such as a metallic member. As the rotator 3 rotates about the rotation shaft 6 as the center of rotation, a gap between both the dielectric plate 1 and the conductive strip 2 and the rotator surface periodically changes. This gap causes a change in the phase constant of the microstrip line, resulting in a periodic change in the phase of a signal propagating thereon.

It is not necessary that the rotator 3 be completely formed of a conductive member, but may be formed by forming an electrode film on substantially the entirety of an insulating base surface.

It is not necessary that the rotator 3 be an elliptic cylinder, but may be a cylinder whose rotation axis is off-centered with respect to the center of rotation symmetry so that the gap between the rotator surface and both the dielectric plate 1 and the conductive strip 2 changes as the rotator 3 rotates.

Figure 4A:
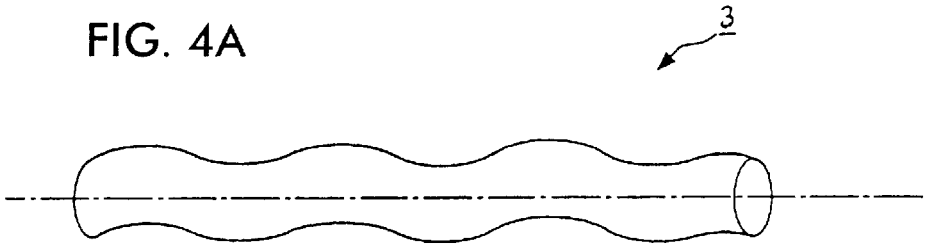
FIGS. 4A and 4B are diagrams of other shapes of the rotator for use in the phase shifter.
Figure 4B:
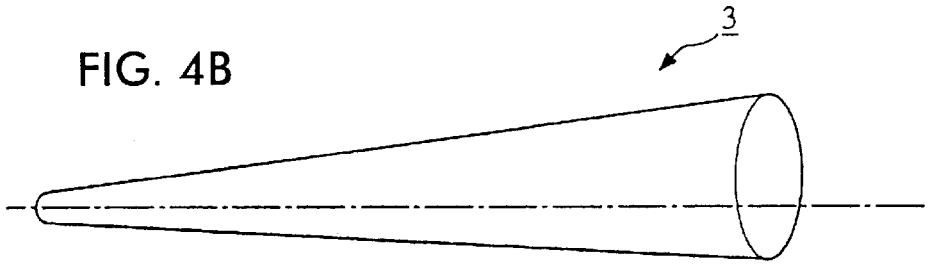

FIGS. 4A and 4B show other shapes of the rotator 3.

In FIG. 4A, the rotator 3 is configured so as to have a substantially constant cross-section while the off-center direction and off-center amount with respect to the rotation axis in cross section change depending upon the axial position of the rotation axis, which is indicated by the dot chain line.

In FIG. 4B, the rotator 3 is configured so that the cross section differs on the axis of the rotational center, which is indicated by the dot chain line.

Irrespective of the rotator shape, as the rotator 3 rotates, the distance from the dielectric plate 1 and the conductive strip 2 to the rotator surface changes, which causes a corresponding change in the capacitance, thereby changing the phase constant of the microstrip line. Therefore, the phase shift can be controlled by rotation of the rotator 3.

A phase shifter according to a second embodiment of the present invention is now described with reference to FIGS. 5 and 6. The phase shifter according to the second embodiment uses a dielectric line as a transmission line.

Figure 5:
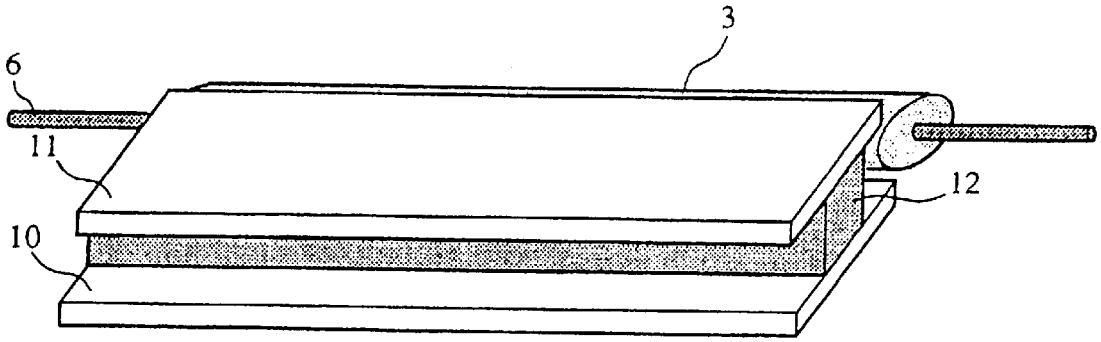
FIG. 5 is a perspective view of a phase shifter according to a second embodiment of the present invention.

In FIG. 5, a dielectric strip 12 is sandwiched between conductive plates 10 and 11 to form a dielectric line. A rotator 3 is positioned at one side of the dielectric strip 12 so that its rotation axis is substantially parallel to the dielectric strip 12. The rotator 3 is constructed in the same manner as shown in FIG. 3.

Figure 6:
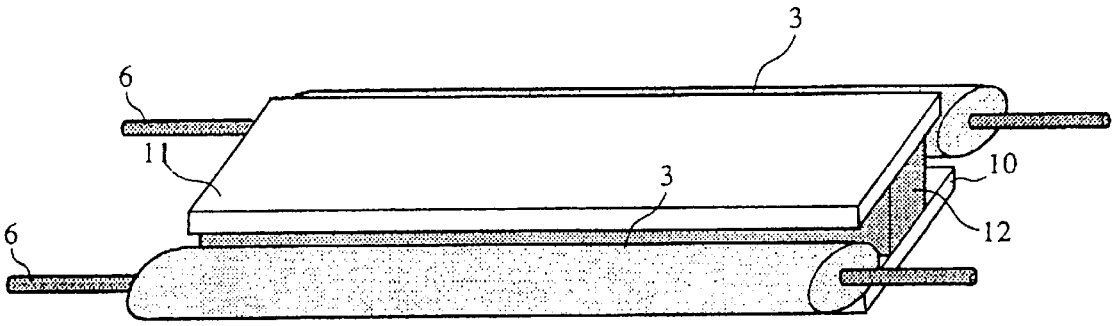
FIG. 6 is a perspective view of a modification of the phase shifter having a rotator arranged in a different manner.

In FIG. 6, a dielectric line is formed of upper and lower conductive plates 10 and 11 and a dielectric strip 12. Two rotators 3 are positioned at the two sides of the dielectric strip 12.

With either structure shown in FIG. 5 or 6, as the rotator(s) 3 rotates, the distance from the rotator(s) 3, which is a conductor, to the dielectric strip 12 changes, causing a change in the phase constant of the dielectric line, resulting in a change in phase of a signal propagating on the dielectric line.

As shown in FIG. 6, the rotators 3 which are positioned at the two sides of the dielectric strip 12 can maintain horizontal symmetry with respect to the direction of electromagnetic propagation on the dielectric line. This prevents conversion to unwanted spurious modes, thereby reducing the loss resulting from mode conversion. Furthermore, two rotators can achieve a larger amount of phase shift.

The rotator(s) 3 shown in FIG. 5 or 6 may be wholly formed of a conductive member, or, alternatively, may be formed by forming an electrode film on substantially the entirety of an insulating base surface. As in the application to a microstrip line previously described, the rotator(s) 3 may also have any configuration in cross section, or may have a different configuration in cross section at points along the rotation axis.

A phased-array antenna according to a third embodiment of the present invention is now described with reference to FIG. 7.

Figure 7:
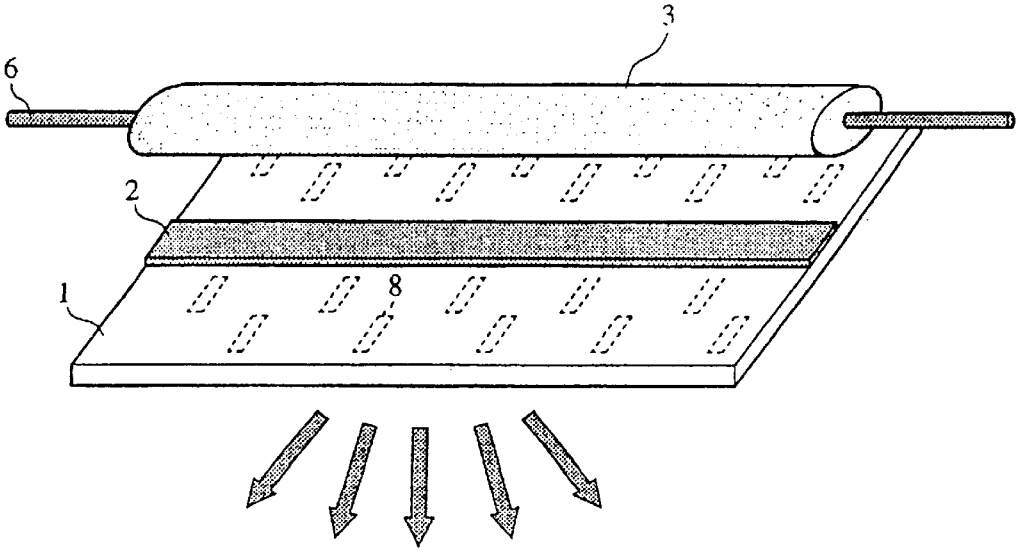
FIG. 7 is a perspective view of a phased-array antenna according to a third embodiment of the present invention.

In FIG. 7, a conductive strip (strip line) 2 is formed on the top surface of a dielectric plate 1. A ground electrode is formed on substantially the entirety of the under surface of the dielectric plate 1, in which a plurality of slots 8 are formed so that the electrode is partially made open at predetermined positions.

The dielectric plate 1, the ground electrode on the under surface, and the conductive strip 2 form a microstrip line, from which an electromagnetic field radiates downward through the slots 8. If a feed is in-phase with respect to the slots 8, the axis of the beam is directed orthogonally to the dielectric plate 1. If a feed is out-of-phase with respect to the slots 8, so that the phase is progressively delayed or advanced along the conductive strip 2, beam scanning can be performed on the plane orthogonal to the dielectric plate 1. As previously described with reference to the embodiments of the phase shifter, as the rotator 3 in proximity to the conductive strip 2 rotates, the distance from the rotator surface to the conductive strip 2 successively changes, causing a successive change in the phase constant of the microstrip line. As a result, the feed is out-of-phase with respect to the plurality of slots 8 along the conductive strip 2. Thus, beam scanning is performed according to the rotation of the rotator 3.

A phased-array antenna according to a fourth embodiment of the present invention is now described with reference to FIG. 8.

Figure 8:
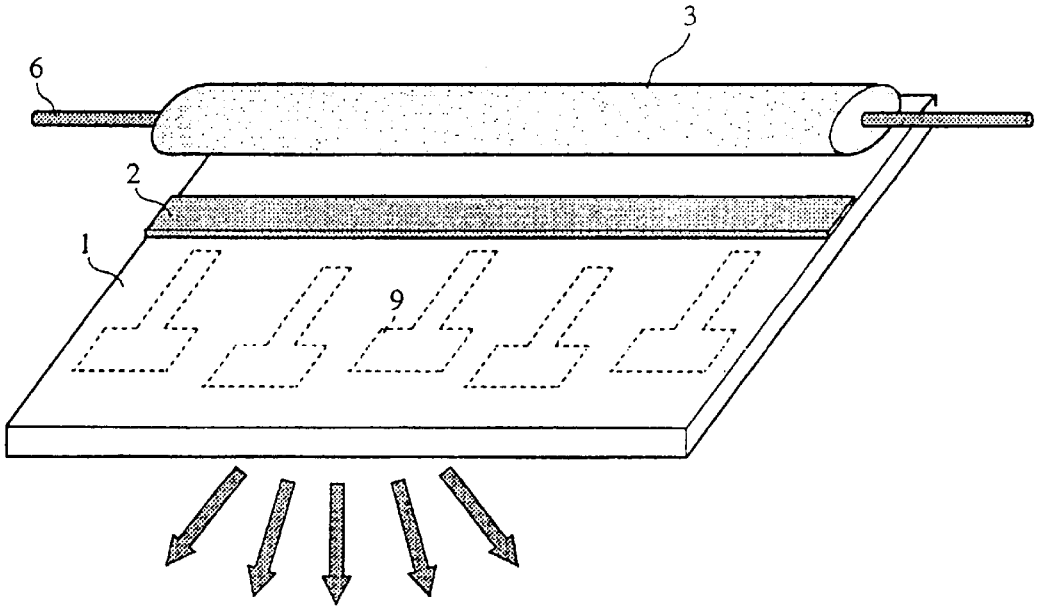
FIG. 8 is a perspective view of a phased-array antenna according to a fourth embodiment of the present invention.

In FIG. 8, a conductive strip 2 and microstrip antenna patches 9 are formed on the top and under surfaces of a dielectric plate 1, respectively. The patches 9 on the under surface of the dielectric plate 1 are coupled with the conductive strip 2 on the top surface. The line formed by the conductive strip 2 serves as a feed line for the microstrip antennas. As the gap between the conductive strip 2 and the rotator 3 changes, the feed shifts the phase with respect to the microstrip antennas. This results in beam scanning in the same way as shown in FIG. 7.

A phased-array antenna according to a fifth embodiment of the present invention is now described with reference to FIG. 9.

Figure 9:
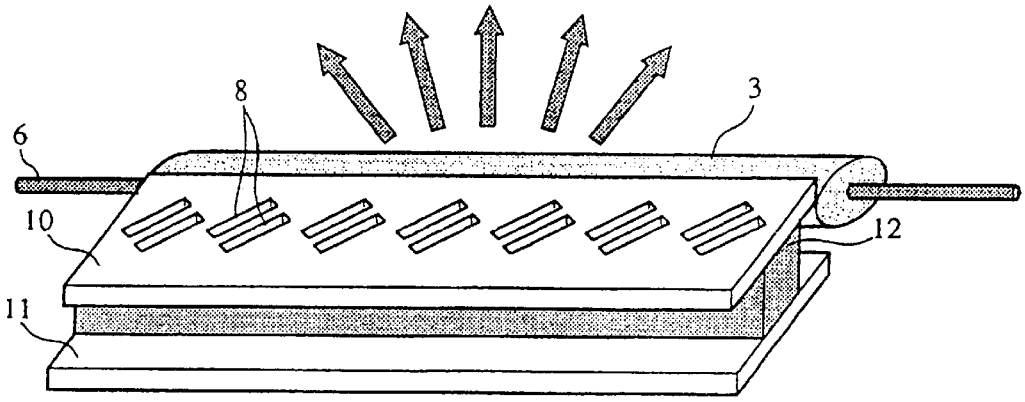
FIG. 9 is a perspective view of a phased-array antenna according to a fifth embodiment of the present invention.

In FIG. 9, a dielectric strip 12 is placed between conductive plates 10 and 11, thereby forming a dielectric line. As shown in FIG. 9, a plurality of slots 8 are formed in the conductive plate 10. Electromagnetic waves propagating on the dielectric line are emitted through the slots 8, serving as slot antennas. A rotator 3 which is constructed in the same manner as previously described for the phase shifter is positioned at one side of the dielectric strip 12, and the phase constant of the dielectric strip 12 changes as the rotator 3 rotates. However, the shape of the rotator 3 is determined so that the phase constant progressively changes in the direction of electromagnetic propagation on the dielectric line. Therefore, the feed progressively shifts in phase with respect to the slots 8 in the direction of electromagnetic propagation on the dielectric line as the rotator 3 rotates, resulting in beam scanning.

Although the slots 8 are formed in the upper conductive plate 10 in FIG. 9, slots may be formed in the lower conductive plate 11 in the same way to emit the beam downward. The structure in which slots are formed in both upper and lower conductive plates allows the beam to be emitted upward and downward.

A phased-array antenna according to a sixth embodiment of the present invention is now described with reference to FIG. 10.

Figure 10:
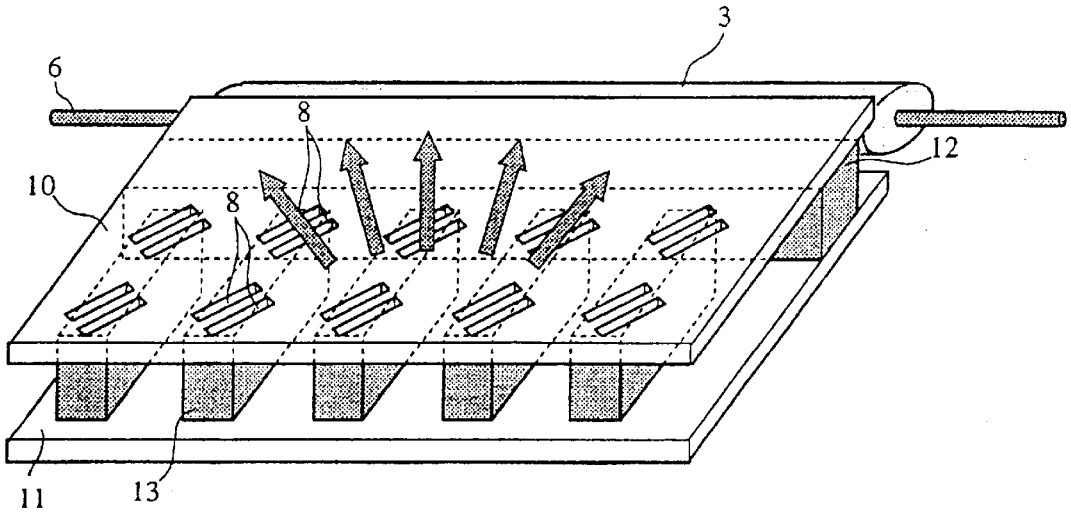
FIG. 10 is a perspective view of a phased-array antenna according to a sixth embodiment of the present invention.

In FIG. 10, a primary dielectric strip 12 and a plurality of auxiliary dielectric strips 13 which extend perpendicularly to the primary dielectric strip 12 are sandwiched between conductive plates 10 and 11. The upper and lower conductive plates 10 and 11, and the dielectric strip 12 and the dielectric strips 13 sandwiched therebetween form dielectric lines. The dielectric line formed by the dielectric strip 12 and the conductive plates 10 and 11 is coupled with the dielectric lines formed by the dielectric strips 13 and the conductive plates 10 and 11. Slots 8 are formed in the conductive plate 10 along the dielectric strips 13. With this structure, electromagnetic waves propagating on the dielectric strips 13 are emitted through the slots 8. As in the embodiment shown in FIG. 9, a rotator 3 is positioned at one side of the dielectric strip 12, and the phase constant of the dielectric line formed by the dielectric strip 12 continuously changes in the direction of electromagnetic propagation as the rotator 3 rotates. This results in beam scanning in the same way as shown in FIG. 9.

Although the slots 8 are formed in the upper conductive plate 10 in FIG. 10, slots may be formed in the lower conductive plate 11 in the same way to emit the beam downward. Slots which are formed in both the upper and lower conductive plates would allow the beam to be emitted upward and downward.

A radar apparatus according to a seventh embodiment of the present invention is now described with reference to FIG. 11.

Figure 11:
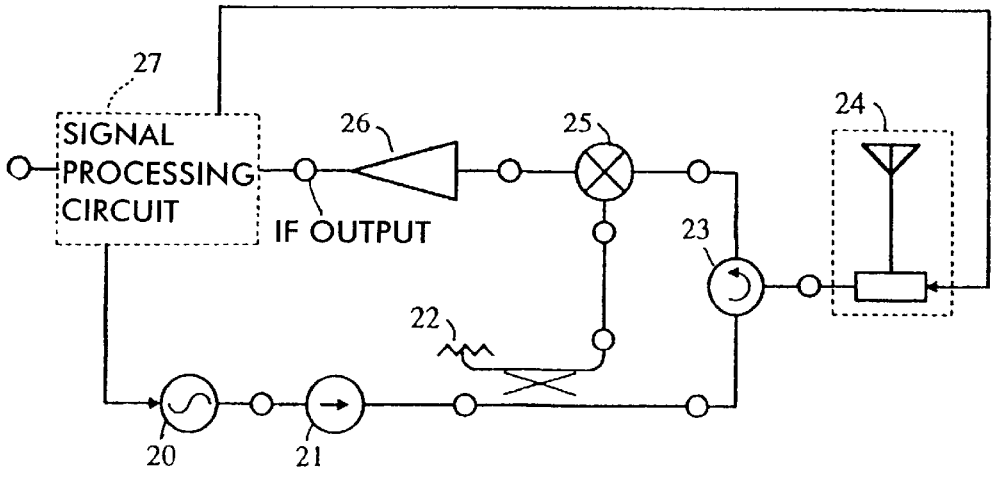
FIG. 11 is a block diagram of a radar according to a seventh embodiment of the present invention.

In FIG. 11, a voltage controlled oscillator (VCO) 20 includes a Gunn diode, a varactor diode, and the like. An isolator 21 prevents a reflected signal from returning to the VCO 20. A coupler 22 is a directional coupler including an NRD guide for taking a portion of transmission signal as a local signal. A circulator 23 is operated to feed the transmission signal to an antenna 24, and to transmit a received signal toward a mixer 25. The mixer 25 mixes the received signal with the local signal to output an intermediate frequency signal. An IF amplifier 26 amplifies the intermediate frequency signal to apply the resulting IF signal to a signal processing circuit 27. The signal processing circuit 27 detects the distance to a target object and the relative velocity on the basis of a relationship between a modulation signal of the VCO 20 and the received signal.

The antenna 24 is implemented by the antenna apparatus described with reference to FIGS. 7 to 10. As described above, beam scanning is performed by rotational control of a rotator in the antenna apparatus, allowing for beam scanning at low power, so that low power consumption can be achieved as a whole. Furthermore, the antenna apparatus is not susceptible to vibrations associated with beam scanning, resulting in increased scanning speed and increased shock resistance. Higher-speed beam scanning is possible for the same reason, thus increasing the radar coverage range whereby a target can be located from within a broader beam scanning range in a shorter period of time.

Although the present invention has been described in relation to particular embodiments thereof, many other variations and modifications and other uses will become apparent to those skilled in the art. Therefore the present invention should be limited not by the specific disclosure herein, but only by the appended claims.

What is claimed is:

1. A phase shifter comprising:

a substantially planar dielectric plate;

a conductive strip formed on the dielectric plate; and a rotator at least partially including a conductor and a dielectric, said rotator being positioned in proximity to said conductive strip so as to rotate, wherein said rotator has a predetermined conductive pattern formed on a surface of a tubular or cylindrical dielectric base.

2. A phased-array antenna comprising:

the phase shifter of claim 1, a ground electrode formed on the dielectric plate; and a plurality of slots formed in the ground electrode, through which electromagnetic waves are emitted.

3. A phased-array antenna comprising:

the phase shifter of claim 1, and microstrip antenna patches formed on the dielectric plate.

4. A radar comprising:

a phased-array antenna including the phase shifter of claim 1, a ground electrode formed on the dielectric plate;

a plurality of slots formed in the ground electrode, through which electromagnetic waves are emitted; and a transceiver unit using the phased-array antenna for transmission and reception.

5. A radar comprising:

a phased-array antenna including the phase shifter of claim 1, microstrip antenna patches formed on the dielectric plate; and a transceiver unit using the phased-array antenna for transmission and reception.

* * * * *